US005431395A

United States Patent [19]

Ganger, Sr.

[11] Patent Number: 5,431,395

[45] Date of Patent: * Jul. 11, 1995

[54] DEVICE TO ASSURE SPORTSMEN A PROPER GRIP

[75] Inventor: David E. Ganger, Sr., Cape Coral, Fla.

[73] Assignee: Tone Trainer, Inc., Cape Coral, Fla.

[ * ] Notice: The portion of the term of this patent subsequent to Jun. 21, 2011 has been disclaimed.

[21] Appl. No.: 230,106

[22] Filed: Apr. 20, 1994

Related U.S. Application Data

[63] Continuation of Ser. No. 53,485, Apr. 29, 1993, Pat. No. 5,322,281.

[51] Int. Cl.[6] ..... A63B 49/00

[52] U.S. Cl. ..... 273/75; 273/29 A; 273/73 R; 273/187.5; 273/183.1

[58] Field of Search ..... 273/29 R, 29 A, 73 R, 273/73 J, 75, 81 R, 81 D, 32 R, 35 R, 187.5, 183.1

[56] References Cited

U.S. PATENT DOCUMENTS

| | | |
|---|---|---|
| 3,323,367 | 6/1967 | Searle . |
| 3,762,720 | 10/1973 | Jett . |
| 4,027,879 | 6/1977 | Wright . |
| 4,101,132 | 7/1978 | Conrey et al. . |
| 4,103,896 | 8/1978 | Lorang . |
| 4,138,118 | 2/1979 | Budney . |
| 4,822,042 | 4/1989 | Landsman . |
| 4,861,034 | 8/1989 | Lee . |
| 4,930,785 | 6/1990 | Mills . |
| 5,031,909 | 7/1991 | Pecker . |
| 5,221,088 | 6/1993 | McTeigue et al. . |

FOREIGN PATENT DOCUMENTS

| | | |
|---|---|---|
| 2626483 | 8/1989 | France . |
| 1587191 | 4/1981 | United Kingdom . |
| 2250923 | 6/1992 | United Kingdom . |

OTHER PUBLICATIONS

Tennis Science for Tennis Players by Howard Brody, Publisher University of Pennsylvania Press, Philadelphia, 1987, pp. 57–60.

Step by Step Tennis Skills, The Definitive Guide to Winning Play, Hamlyn Publishing Group 1991, p. 31.

Tennis by Pancho Gonzales and Dick Hawk, publisher Angel Books—New York, 1972, pp. 25–26.

Sports Illustrated Book of Tennis, publisher J. B. Lippincott.

Efficiency Racquet Sports, Gene R. Hagerman et al., publisher Bantam Books, 1987, p. 83.

*Primary Examiner*—Raleigh W. Chiu

*Attorney, Agent, or Firm*—Robert C. Kain, Jr.

[57] ABSTRACT

The device tests the pressure and positioning of a player's hand on the grip of sports equipment. The device generates an audible signal of confirmation when a lower threshold of pressure at predetermined locations on the grip are achieved. In many sports a major hindrance to a player in perfecting his or her game is the lack of maintaining a proper grip on the sports equipment. An important aspect of many sports including tennis, racquetball, golf, baseball and hockey is to maintain proper hand position and a firm grip on the sports equipment used. This sports equipment includes, amongst others, the tennis racket in tennis, the racket in racquetball, the golf club in golf, the bat in baseball and the stick in hockey. Proper grip and the ability to properly maintain the correct grip on the equipment is of paramount importance to consistent play. This device will attached to and encircle the various sports equipment at their handles so as to be between the hand or hands of the player and the sports equipment being gripped during play. The audible sound will act to confirm to the player that he or she has a sufficiently firm grip with a proper hand position on the sports equipment. By establishing a confirmation of a proper grip the player will then be able to concentrate on the other aspects of the particular game free from the concern about his or her grip.

11 Claims, 4 Drawing Sheets

DEVICE TO ASSURE SPORTSMEN A PROPER GRIP

This is a continuation of U.S. patent application Ser. No. 08/053,485, filed Apr. 29, 1993, now U.S. Pat. No. 5,322,281.

BACKGROUND OF THE INVENTION

1. Field of the Invention

The present invention relates to a device and its method of use that would confirm to the player, of various sports, that proper hand position, with a sufficiently firm grip, was established and was being maintained. It should be noted that a consistent hand position aids the player in establishing a proper relationship with the ball. This invention would be installed, by the user, by attaching the apparatus so as to surround the handle, and be securely attached thereto, on existing sports equipment. The purpose being to prevent the player from attempting play without proper form, as it relates to hand position and firmness of grip, being present. The invention would have at least one sensor device in the form of a pressure activated switch. These switches would be such that the individual player could align, and thus adjust, them with the desired pressure points on the grip. This would allow the player to modify the invention so as to be activated by the proper pressure points of his or her specific hand.

2. Brief Description of the Prior Art

Many sports make use of equipment that is carried by the individual players during play. Proper hand position and a firm grip are stressed during the training of players in many of these sports. Currently there is known in the art various handles that attempt to cause the player to maintain proper hand position. These grips are of the shaped variety with various indentations that cause the player to properly position his or her hands in order to comfortably hold the equipment. These grips are such that customization is difficult and expensive. These grips also fail to address the problem of maintaining a firm grip.

OBJECTS OF THE INVENTION

The principal object of the invention is to assure sports persons of a proper grip on the sports equipment in use. Several other objects and advantages of the present invention are:

(a) to provide a method of confirming to the player that proper hand position has been established on the sports equipment in use.

(b) to provide a method of confirming to the player that a sufficiently firm grip has been established on the sports equipment in use.

(c) to provide a method of alerting the player that proper hand position of the sports equipment in use has been lost during play.

(d) to provide a method of alerting the player that his or her sufficiently firm grip on the sports equipment in use is not being maintained during play.

(e) to provide the player with the ability to position the pressure activated switches, incorporated in the apparatus, in such a way as to match predetermined positions or the fingers and palm of the hand of the player.

(f) to provide the player with the ability to select the lower threshold of activation of the audio signal so as to allow the invention to be used by players of varying hand strengths.

(g) to provide for the rehabilitation of stroke and other disabled persons by allowing the establishment of goals with the devices use in therapy. One usage would establish a lower threshold of pressure and allow the patient to repeatedly achieve this goal. It would optionally allow for monitoring of the duration of time that the goal was met with each repetition. The threshold of pressure or the duration of time achieved could then be increased as the patient progresses in the therapy.

(h) to provide for a device which could be secured to the steering wheel of a vehicle where it would emit an audio signal when the pressure applied by the grip of the hand lessened. This would provide for a method of alerting the driver that their attention is diminishing. Still further objects and advantages of the invention will become apparent to those skilled in the art from the detailed description which follows. It should be understood, however, that the detailed description, while indicating preferred embodiment, is given as an example and not a limitation. Many changes and modifications to the invention are possible without departing from the spirit and scope of the invention, and all such modifications are included.

BRIEF DESCRIPTION OF THE DRAWINGS

Like references numerals refer to like elements throughout the various views.

SUMMARY OF THE INVENTION

It would be extremely desirable to have a device that would assure the player that their grip was proper. This invention is designed to perform this task and thus will be an aid to players of many sports. It would allow the individual player to concentrate on the other aspects of the respective game without concern that the fundamentals of that game were not present.

Similarly it will aid in the rehabilitation of individuals with injuries or other medical problems. It will also aid drivers and others that, for safety reasons, must stay attentive during the operation of that equipment.

DESCRIPTION OF THE PREFERRED EMBODIMENT

Figure 1:
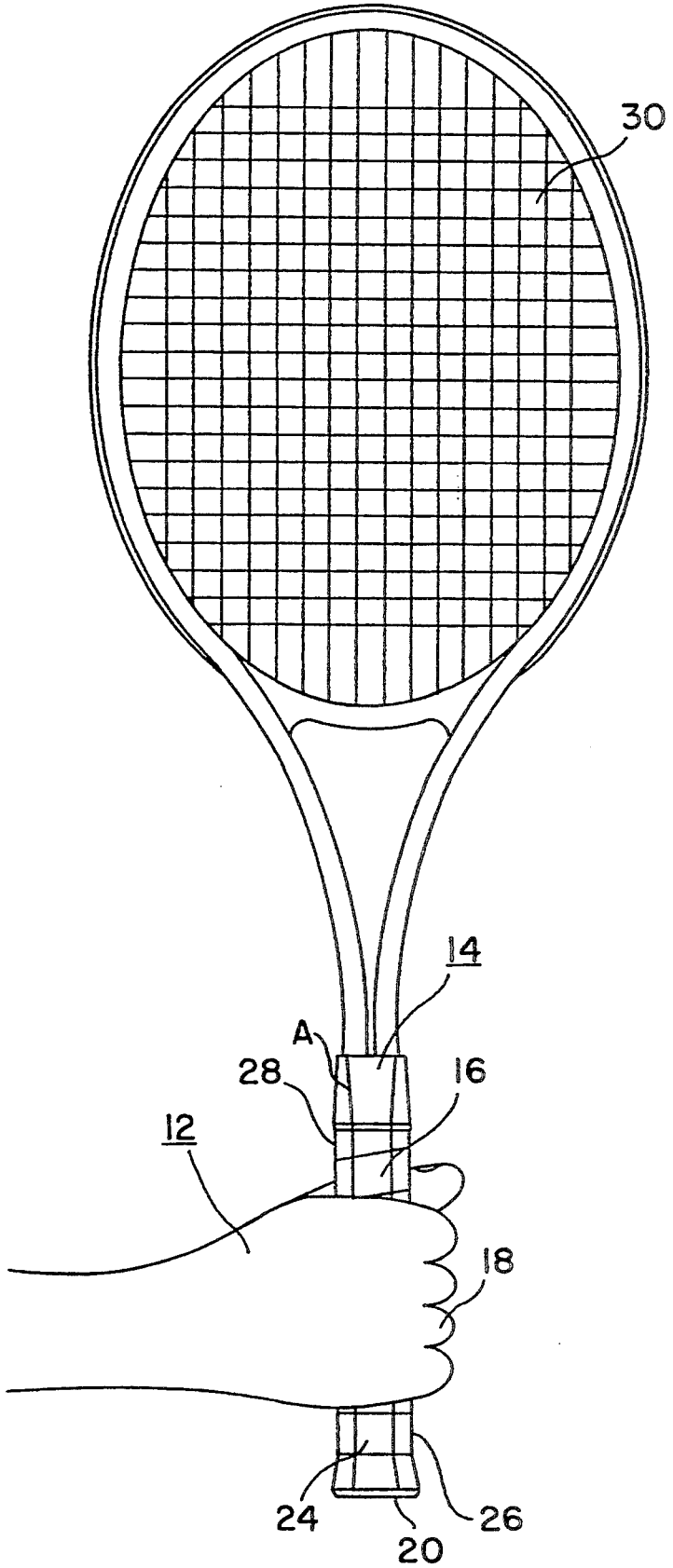
FIG. 1 is a plan view of a tennis racket being gripped by a hand.

Referring now to the drawing FIG. 1 shows a plan view of a racket 14 being properly gripped by a hand 12 having FIGS. 18 at grip 16. Grip 16 having side 24, side 26 and side 28. It being understood that grip 16 has a fourth side not shown in FIG. 1. Racket 14 further having base 20 and 30. End 30 is utilized during play to strike a tennis ball.

Figure 2:
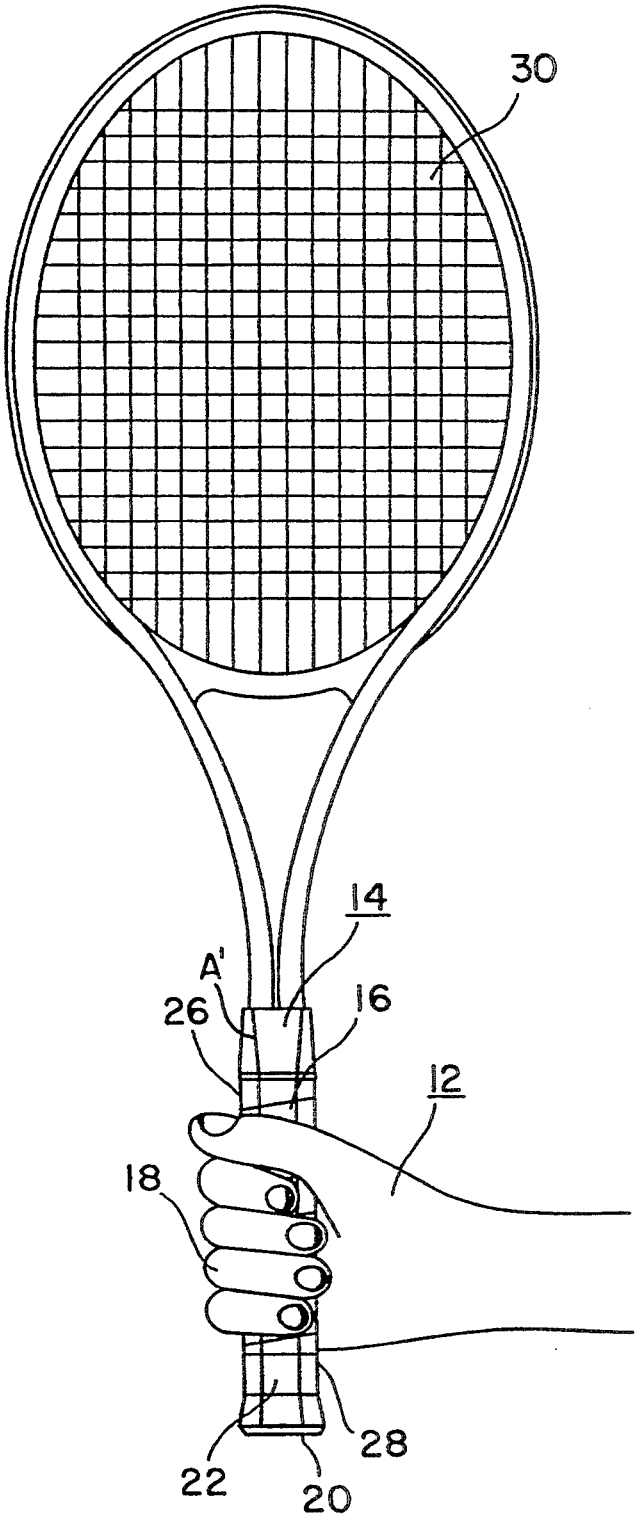
FIG. 2 is a plan view of the opposing side of the tennis racket and hand shown in FIG. 1.

FIG. 2 shows a plan view of the opposing side of racket 16 as illustrated in FIG. 1. Shown gripping racket 14 utilizing grip 16 is hand 12 having fingers 18. Grip 16 having side 22, side 26 and side 28. It being understood that grip 16 has a fourth side not shown in FIG. 2. Racket 14 further having base 20 and end 30.

End 30 is utilized as previously described. FIGS. 1 and 2 illustrate longitudinal alignment indicia or breaks A and A'.

It being understood that wile a tennis racket is utilized for the preferred embodiment that many different pieces of sports equipment could be utilized with the invention.

Figure 3:
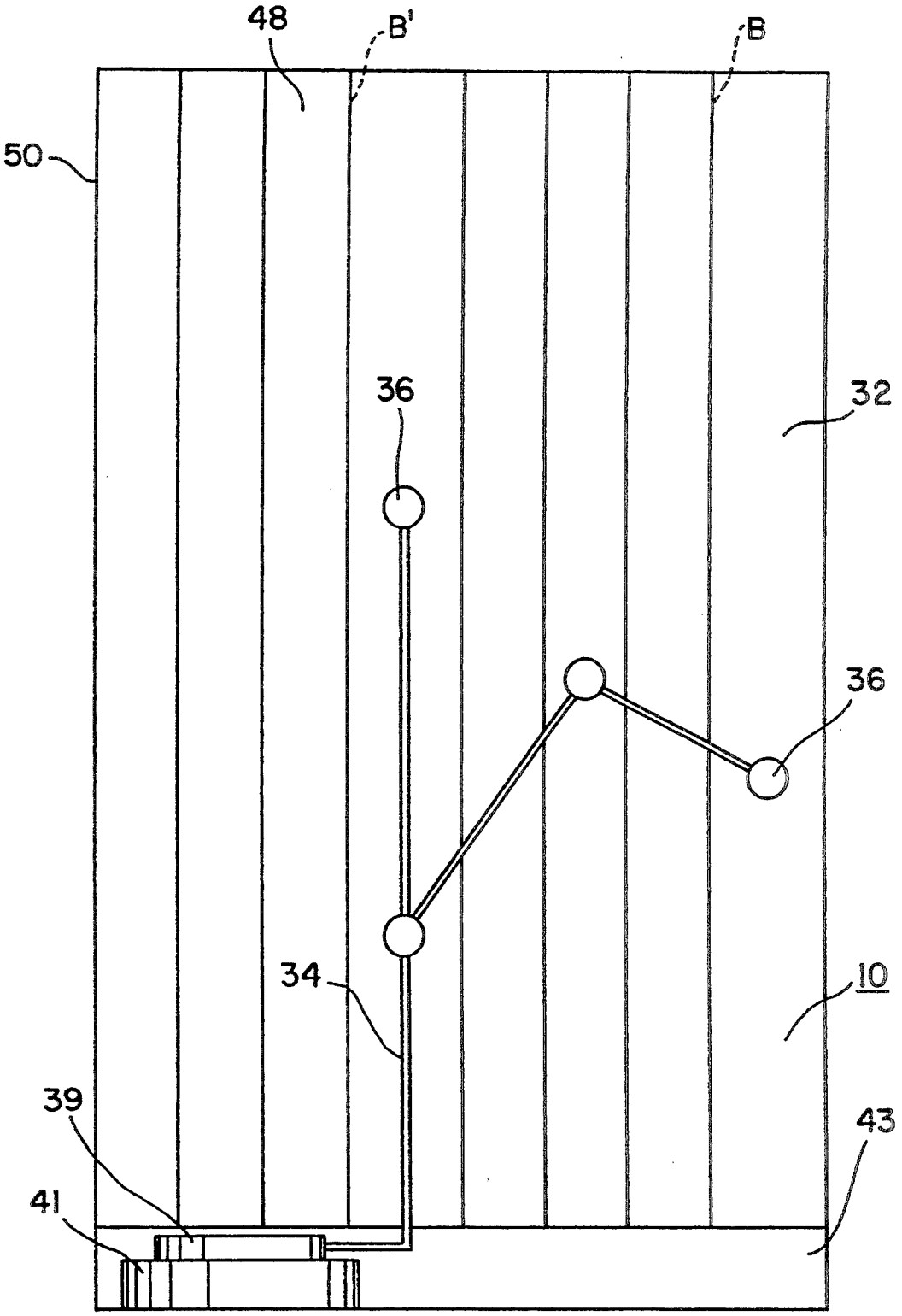
FIG. 3 is a plan view of the device laying flat.

FIG. 3 shows a plan view of device 10. Device 10 is illustrated flat in this view while the device would be wrapped around, enclose and be securely attached to the grip of the desired piece of sports equipment when in use. Shown is a wrap 32 having an inner surface 48 and an outer surface 50. It being understood that in use inner surface 48 would be in contact with the grip of the chosen sports equipment and a portion of outer surface 50 would be in contact with the players hand. Attached to inner surface 48 are switches 36 connected together utilizing wire 34. Wire 34 being capable of conducting electricity. Wrap 32 further having base 43 having attached thereto battery 39 and speaker 41. It being understood that battery 39 is connected to speaker 41. It further to understood that battery 39 and speaker 41 are attached to switches 36 utilizing wire 34. It being understood that speaker 41 is an audio signal generating device. As stated earlier, the switch may be a pressure activated switch.

FIG. 3 also illustrates longitudinal alignment indicia B and B'. As stated earlier, the player may align the wrap and particularly alignment indicia B and B' with racket handle alignment indicia A and A' such that the wrap and, hence, the switches would be located at the desired grip pressure points on the racket handle.

Figure 4:
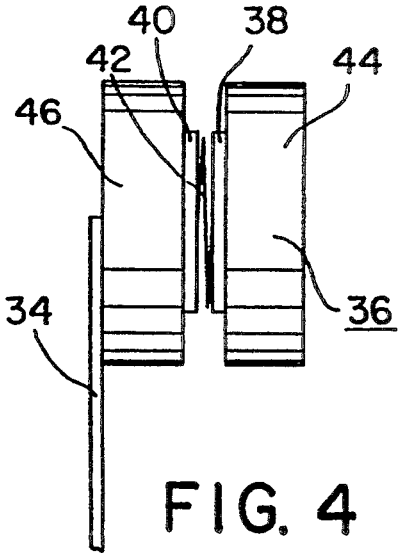
FIG. 4 is a plan view of a switch.

FIG. 4 shows a plan view of switch 36 having two sides 44 and 46. Attached to side 46 is wire 34 and connector 40. Attached to side 44 is connector 38. Connector 38 and connector 40 are held apart by spring 42. When sufficient pressure is applied to switch 36 so as to push side 44 toward side 46 connector 38 will come in contact with connector 40. When this occurs an electric charge flows through wire 34.

Figure 5:
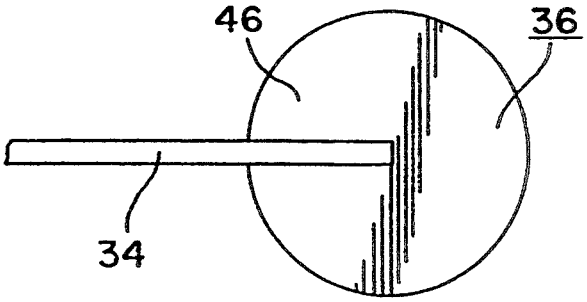
FIG. 5 is a plan view of a switch.

FIG. 5 shows a second plan view of switch 36. Shown is side 46 with wire 34 connected.

Figure 6:
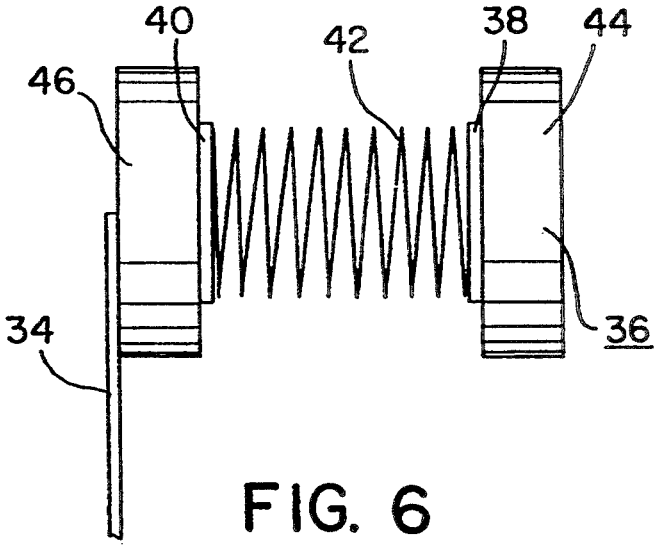
FIG. 6 is a plan view of a switch extended.

FIG. 6 shows a plan view of switch 36 in an extended form so as to illustrate spring 42 more fully. Switch 36 having side 44 with connector 38 attached. Switch 36 further having side 46 with connector 40 attached. Attached to side 46 is wire 34.

Device 10 would be installed on and surround the grip of existing sports equipment. Switches 36 would be positioned in such orientation so as to align with desired positions on the hand and fingers. When a sufficient pressure is applied to the switches 36 a closed circuit is formed and battery 39 sends an electric charge to speaker 41. Speaker 41 then generates an audio signal that confirms to the player that proper hand position with the desired pressure is present.

CONCLUSIONS AND RAMIFICATIONS OF THE INVENTION

The preferred embodiment describes the use of the invention as it would relate to tennis. While tennis players would benefit greatly from the invention, all sports players would be able to profit from the invention. Due to the similarities between the two sports, racquetball players would equally gain from the use of the invention.

Golf players have often sought a method of assuring a proper grip on the golf clubs that they use. The invention will aid them greatly. Golf is a sport that the player must get beyond the basics if they wish to master the sport.

Baseball is another sport that requires proper hand position. Although to a lesser degree than the other sports mentioned.

All sports that require a grip on the equipment would benefit from the invention. It will be possible to have the device equipped with a manually operated switch. The individual user would be able to turn the device on and off. The device could be modified so that the audio signal would be activated when the device was not being properly gripped. This would benefit the player greatly. This would further allow for instructors of the various sports to be notified that the proper hand position has been lost during training.

Similarly this device could be used for many situations that require an individual to hold an item during use where the individual must also stay attentive. The device would be capable of warning the user that his attention is diminished.

What is claimed is:

1. A training device for audibly indicating a proper grip on a racket comprising:
   - a thin sheet wrap around sized to surround an outside grip surface of a racket handle;
   - a thin electrical switch having a switch thickness which does not substantially exceed a thickness of said thin sheet wrap, said switch retained on said thin sheet wrap;
   - means for securing said thin sheet wrap on said racket handle;
   - a portable power source electrically coupled to an audible alarm, both of which are retained on said racket; and
   - electrical connectors coupling said thin switch with said power source and said audible alarm such that upon closure of said switch, said alarm sounds.

2. A training device as claimed in claim 1 including a plurality of switches mounted beneath said wrap and electrically connected via respective connectors to said power source and said alarm.

3. A training device as claimed in claim 2 wherein said plurality of switches are adapted to be disposed at predetermined grip positions about said tennis racket handle.

4. A training device as claimed in claim 1 including a variable threshold circuit for said audible alarm to enable a player to adjust the level of activation of an audible alarm signal.

5. A training device as claimed in claim 1 wherein said electrical switch is a pressure activated switch.

6. A training device as claimed in claim 5 wherein said pressure activated switch is a variable threshold control to enable a player to adjust the level of activation of said audible alarm.

7. A training device as claimed in claim 1 wherein said racket handle includes at least one racket aligmnent indicator and said wrap includes at least one wrap alignment indicator whereby a player positions said wrap, and said switch is adapted to be placed at a predetermined position and with respect to said racket handle by spatial orientation of said wrap aligmnent indicator and said racket alignment indicator.

8. A training device as claimed in claim 1 wherein said device has a plurality of switches and further includes an alignment means to align each of said switches with a desired grip position location on said racket handle.

9. A training device as claimed in claim 1 wherein said switch is retained within said wrap.

10. An electronic method for audibly indicating a proper hand grip by a player on a racket handle comprising the steps of:

locating at least one compressible electrical switch on a wrap surrounding said racket handle;

mounting a portable power supply and an audible alarm on said racket and electrically connecting said power supply, said alarm and said switch together;

compressibly closing said switch with said proper hand grip over a distance which does not substantially exceed a thickness of said wrap; and, audibly announcing said closure of said switch by activation of said alarm.

11. An electronic method for audibly indicating a proper hand grip by a player on a racket handle comprising the steps of:

locating at least one pressure sensitive electrical switch on a wrap surrounding said racket handle;

mounting a portable power supply and an audible alarm on said racket and electrically connecting said power supply, said alarm and said switch together;

applying pressure to said switch with said proper hand grip over a distance which does not substantially exceed a thickness of said wrap; and, audibly announcing activation of said switch with said alarm.

* * * * *